US006739934B1

(12) United States Patent
Adler

(10) Patent No.: US 6,739,934 B1
(45) Date of Patent: May 25, 2004

(54) LONG RANGE FLYING DISC SPORTING TOY

(76) Inventor: Alan J. Adler, 752 La Para Ave., Palo Alto, CA (US) 94306

( * ) Notice: Subject to any disclaimer, the term of this patent is extended or adjusted under 35 U.S.C. 154(b) by 0 days.

(21) Appl. No.: 10/439,901

(22) Filed: May 15, 2003

(51) Int. Cl.[7] ..... A63H 27/00
(52) U.S. Cl. ..... 446/46; 473/588
(58) Field of Search ..... 446/46, 34, 48, 446/61; 473/590, 588, 471; 244/12.2, 23 C

(56) References Cited

U.S. PATENT DOCUMENTS 1,962,927 A * 6/1934 De Bats ..... 446/14
2,211,244 A * 8/1940 Routledge ..... 273/362
3,594,945 A 7/1971 Turney
3,710,505 A * 1/1973 Linenfelser ..... 446/46
3,765,122 A * 10/1973 English ..... 446/48
4,023,805 A * 5/1977 Sherrill ..... 473/588
4,196,540 A * 4/1980 Hembree et al. ..... 446/46
4,560,358 A 12/1985 Adler

* cited by examiner

*Primary Examiner*—Derris H. Banks
*Assistant Examiner*—Bena B. Miller
(74) *Attorney, Agent, or Firm*—Townsend and Townsend and Crew LLP

(57) ABSTRACT

A flying disc sporting toy having a rim of varying radial width which enables it to fly long distances.

6 Claims, 2 Drawing Sheets

LONG RANGE FLYING DISC SPORTING TOY

This invention relates generally to flying sporting toys, and more particularly to flying disc sporting toys.

SUMMARY OF THE INVENTION

The present invention provides a flying disc sporting toy having a rim of varying radial width which enables it to fly long distances. Embodiments of the present invention are suitable for such uses as in the game of disc golf and in distance throwing practice and competition.

The present inventor has discovered that discs having wide rims fly farthest. The inventor has also discovered that if the rim is too wide, the thrower encounters difficulty maintaining a secure grip on the rim up to the desired instant of release. The present invention provides both the long flight benefits of a wide rim and a narrower rim region for a secure grip.

A further understanding of the nature and advantages of the present invention may be realized by reference to the remaining portions of the specification and the drawings.

DETAILED DESCRIPTION OF THE INVENTION

Figure 1:
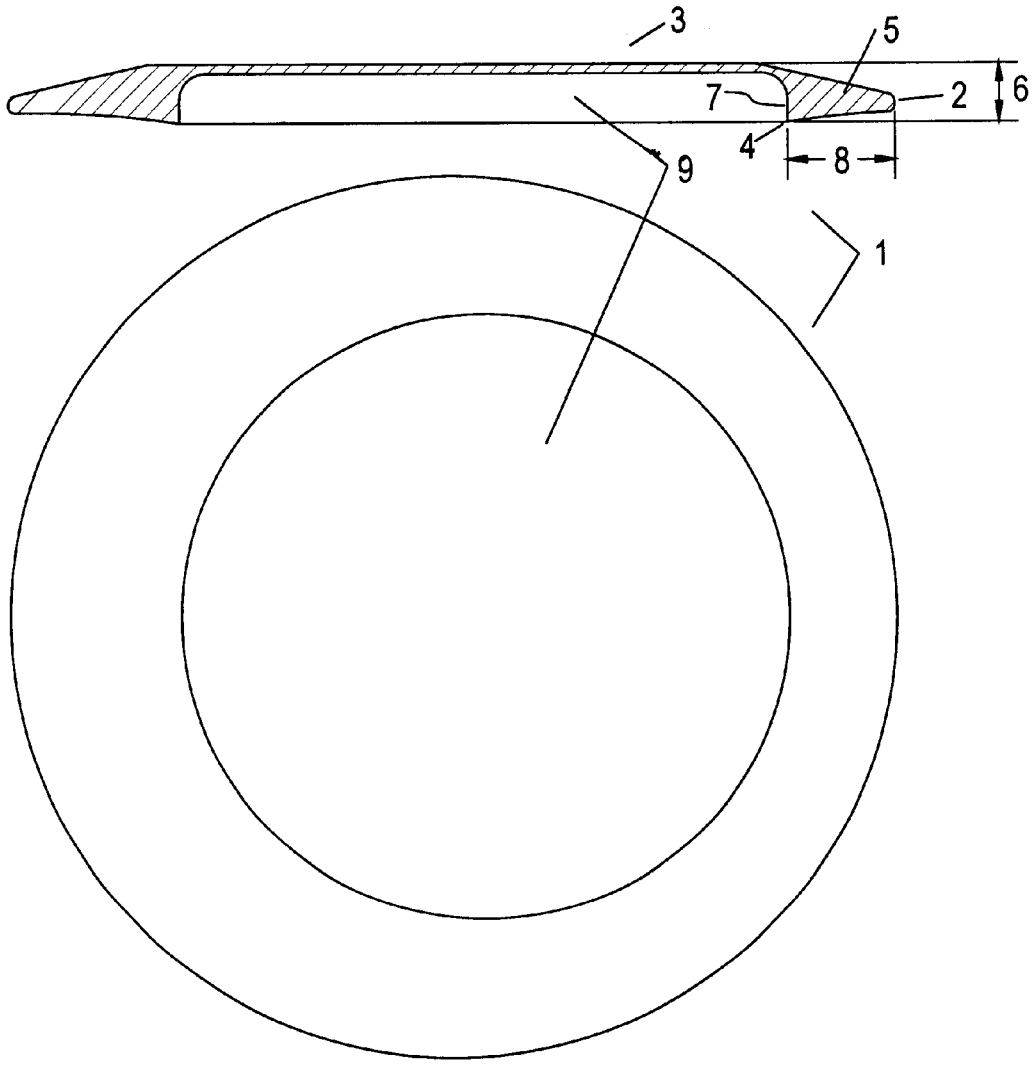
FIG. 1 is a cross-section and bottom view of a disc according to an embodiment of the invention.

FIG. 1 illustrates an embodiment of a flying disc sporting toy 1 (sometimes referred to simply as the disc) having a maximum axial thickness 6, an outer perimeter 2 and an upper surface 3. Like many flying disc toys, the invention has a lower cavity 9 circumscribed by a wall 7 and extending axially upward to slightly below upper surface 3. The disc is characterized by a lowermost edge 4 surrounding cavity wall 7 and, in turn, surrounded by outer perimeter 2.

The disc has an outer rim 5. The rim's radial width 8 is defined as the radial distance between the outer perimeter 2 and wall 7 of lower cavity 9. The rim has varying radial width which varies from one or more minimum widths of radial dimension greater than maximum axial thickness 6 to one or more maximum widths of radial dimension at least 1.2 times the minimum width.

The lower portion of FIG. 1 is a bottom view of the disc and illustrates one embodiment of the invention. As can be seen in this figure, lower cavity 9 is circular and eccentric to outer perimeter 2, thus achieving variation in the radial width of rim 5.

Figure 2A:
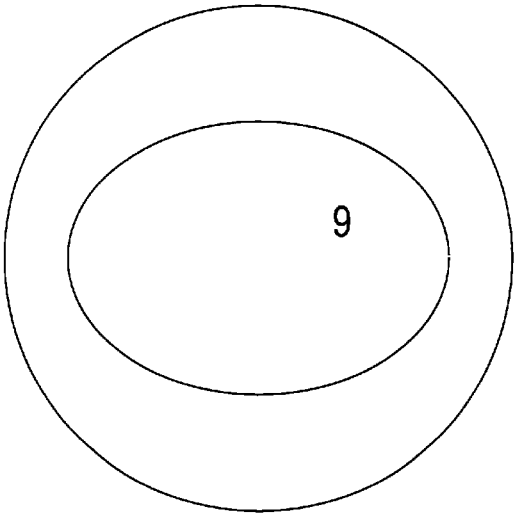
FIGS. 2A through 2D illustrate bottom views of alternative embodiments of the invention.
Figure 2B:
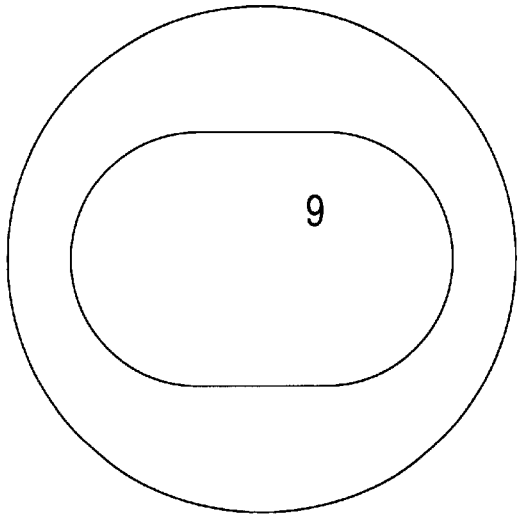
Figure 2C:
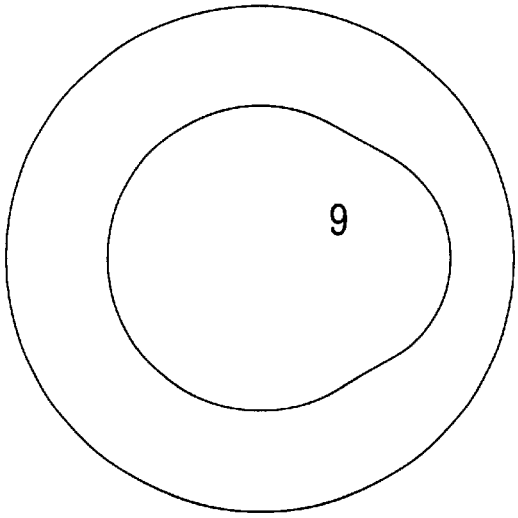
Figure 2D:
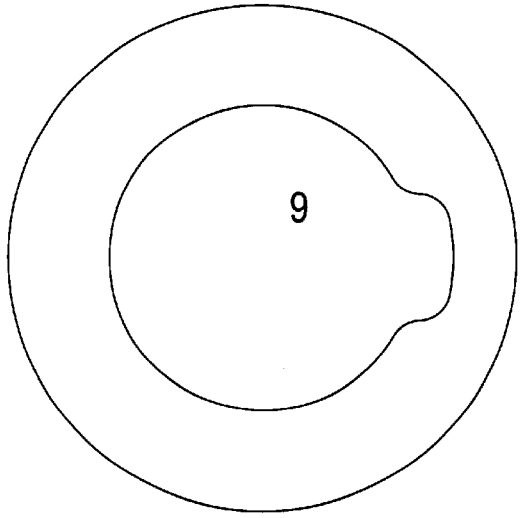

FIGS. 2A through 2D illustrate bottom views of alternative embodiments of the invention. FIG. 2A shows a disc having an elliptical lower cavity 9. This results in two regions of minimum rim width and two regions of maximum rim width. FIG. 2B illustrates a variation of the configuration of FIG. 2A in which the bottom cavity 9 is of oval planform. FIG. 2C illustrates an egg-shaped lower cavity 9 which is extended radially outward in one region in order to achieve the desired variation in rim width. FIG. 2D illustrates an alternative to the disc of FIG. 2C in which the lower cavity 9 is mostly circular, but is extended radially outward in one region in order to achieve the desired variation in rim width. It will be obvious to the reader that other variations of cavity planform are possible in order to achieve the varying rim width according to the invention.

As mentioned above, the present inventor has discovered that discs having wide rims fly farthest, but that if the rim is too wide, the thrower encounters difficulty maintaining a secure grip on the rim up to the desired instant of release. This invention provides both the long flight benefits of a wide rim and a narrower rim region for a secure grip.

The present inventor has discovered that longest flights are achieved in discs whose rims have one or more minimum widths of radial dimension 8 greater than 1.5 times the maximum axial thickness 6 to one or more maximum widths of radial dimension at least 1.5 times the rim's minimum width.

One embodiment of the invention has the following dimensions:

| | |
|---|---|
| Outside diameter | 8.3" |
| Maximum axial thickness | 0.56" |
| Minimum rim width | 1.0" |
| Maximum rim width | 1.6" |

A BRIEF DISCUSSION OF PRIOR ART

There has been a flying disc and a flying ring in the prior art that had variable rim width in order to promote erratic flight.

U.S. Pat. No. 4,023,805 to Sherrill (titled "Tricky Disk") is an example of a disc designed with an object "to provide an aerodynamic toy of this type which, instead of being designed to perform a simple smooth flight pattern, is deliberately designed for a certain amount of erratic, unpredictable action in use." The disc shown in the Sherrill patent has a rim with maximum and minimum radial widths much narrower than the disc's maximum axial thickness. As a result of this relatively narrow rim, the flight range of the "Tricky Disk" is very short. This disc also lacks a lowermost edge which is surrounded by the outer perimeter. The present inventor has found that this omission in a long range disc results in severe instability in flight.

With regard to prior flying rings of variable radial width, it is emphasized that flying disc and flying ring aerodynamics are so different as to render any comparison inappropriate. Flying rings have airflow through the center of the rings, which profoundly affects the flight. Flying discs, of course, lack this airflow and thus fly very differently. And, of course, flying rings have no cavity.

CONCLUSION

While the above is a complete description of specific embodiments of the invention, the above description should not be taken as limiting the scope of the invention as defined by the claims.

What is claimed is:

1. A flying disc sport-toy having:

a maximum axial thickness;

an outer perimeter;

an upper surface;

a lower cavity circumscribed by a wall and extending axially upward to slightly below said upper surface;

an outer rim having a varying radial width defined by said outer perimeter and said cavity wall, said width varying from one or more minimum widths of radial dimension greater than said maximum axial thickness to one or more maximum widths of radial dimension at least 1.2 times said minimum width; and a lowermost edge surrounding said cavity wall and surrounded by said outer perimeter.

2. The flying disc of claim 1 wherein said lower cavity is circular and eccentric to said outer perimeter in order to achieve said varying rim width.

3. The flying disc of claim 1 wherein said lower cavity is extended radially outward in one or more regions in order to achieve said varying rim width.

4. The flying disc of claim 1 wherein at least one of said one or more rim widths has a radial dimensions greater than 1.5 times said maximum axial thickness.

5. The flying disc of claim 1 wherein at least one of said one or more maximum rim widths has a dimensions at least 1.5 times said minimum width.

6. A flying disc sport-toy having:

a maximum axial thickness;

an outer perimeter;

an upper surface;

a lower cavity circumscribed by a wall and extending axially upward to slightly below said upper surface;

an outer rim having a varying radial width defined by said outer perimeter and said cavity wall, said width varying from one or more minimum widths of radial dimension greater than 1.5 times said maximum axial thickness to one or more maximum widths of radial dimension at least 1.5 times said minimum width; and a lowermost edge surrounding said cavity wall and surrounded by said outer perimeter.

* * * * *